US008596897B2

(12) United States Patent
Cole

(10) Patent No.: US 8,596,897 B2
(45) Date of Patent: Dec. 3, 2013

(54) THIS PEN'S THE BALM

(76) Inventor: Matthew Brian Cole, Quakertown, PA (US)

( * ) Notice: Subject to any disclaimer, the term of this patent is extended or adjusted under 35 U.S.C. 154(b) by 33 days.

(21) Appl. No.: 13/317,580

(22) Filed: Oct. 24, 2011

(65) Prior Publication Data

US 2012/0177431 A1 Jul. 12, 2012

Related U.S. Application Data

(60) Provisional application No. 61/460,581, filed on Jan. 6, 2011.

(51) Int. Cl.
*B43K 29/00* (2006.01)
*B43K 27/00* (2006.01)

(52) U.S. Cl.
USPC ..... 401/195; 401/29

(58) Field of Classification Search
USPC ..... 401/195, 29, 110, 143
See application file for complete search history.

(56) References Cited

U.S. PATENT DOCUMENTS

| | | | | | |
|---|---|---|---|---|---|
| 1,749,565 | A * | 3/1930 | Coryell | 132/318 |
| D311,260 | S * | 10/1990 | Hasert | D28/85 |
| 5,938,357 | A * | 8/1999 | Faraj | 401/18 |
| 6,179,504 | B1 * | 1/2001 | Jones | 401/195 |
| 7,377,709 | B2 * | 5/2008 | Butler | 401/195 |
| 7,600,936 | B2 * | 10/2009 | Landow | 401/19 |
| 7,654,762 | B2 * | 2/2010 | Carlino | 401/19 |
| 2013/0170888 | A1 * | 7/2013 | Sheena et al. | 401/195 |

FOREIGN PATENT DOCUMENTS

CN 201745310 U * 2/2011

* cited by examiner

*Primary Examiner* — David Walczak
*Assistant Examiner* — Jennifer C Chiang

(57) ABSTRACT

The functionality and design of this pen is two-fold. The first, lower component is used as a writing implement and the second, upper component is the compartment/housing unit of the lip balm cartridge. The bottom portion of the pen houses the ink cartridge and the mechanical components of the pen. The pen tip is retractable. The upper portion of the pen is the housing chamber for the lip balm. The snap-in design allows a lip balm cartridge to be loaded and unloaded from the pen. Both halves of the pen, top and bottom are connected. Twisting the pen at the union of the lower and upper components releases and retracts the pen tip. The uniqueness of this invention is its' dual usage, one as a pen and the other as a lip balm housing unit.

7 Claims, 3 Drawing Sheets

THIS PEN'S THE BALM

CROSS-REFERENCE TO RELATED APPLICATIONS

This application claims benefit of provisional Application #61/460,581 filed on Jan. 6, 2011.

STATEMENT REGARDING FEDERALLY SPONSORED RESEARCH OR DEVELOPMENT

N/A

REFERENCE TO SEQUENCE LISTINGS, A TABLE, OR COMPUTER PROGRAM LISTING COMPACT DISC APPENDIX

N/A

BACKGROUND OF INVENTION

The invention is unique in the fact there are pens and lip balms available to all consumers. This invention combines both features into one, allowing the user to be able write and when need be have access and use the lip balm without searching for either item.

There is no other item that has this dual functionality of pen and lip balm combined as one.

SUMMARY OF THE INVENTION

The invention is designed to allow the user to attach a lip balm cartridge to a pen. The express purpose is to allow a user dual functionality both as a pen as an implement to apply lip balm. The invention's goal is to eliminate the user from continuously looking for a lip balm cartridge that may be misplaced in a purse, bag, desk, etc. The user may now be able have the convenience of carrying their lip balm and pen together as one.

DETAILED DESCRIPTION OF THE INVENTION

Figure 1:
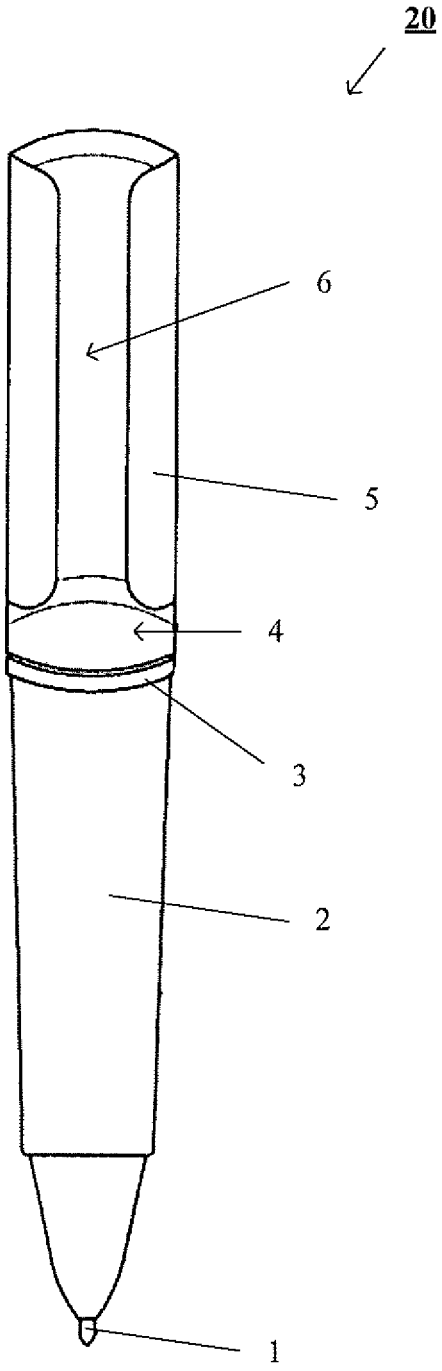
FIG. 1 is a side view displaying the components of the upper and lower sections of the pen.

The pen is different than any other item in the fact that along with the writing component of the pen, it combines with a housing unit for a lip balm cartridge making this device unique.

The composition of this device 20 could be made of plastic or an aluminum/metal alloy. The pen 20 will be constructed using a mold and has two distinct sections. The pen 20 will be described with reference to FIGS. 1, 2, and 3. The lower section, which is reflected in FIG. 1, houses part 1, the retractable pen tip; part 2, the casing for the internal pen components (ink tube); and part 3, the union of the lower and upper casing where the pen is allowed to rotate to retract the pen tip 1. The upper section, which is also reflected in FIG. 1, reflects part 4, the aperture in the upper housing where the lip balm cartridge 9 can be rotated 8 and maneuvered to release the appropriate amount of lip balm when the cap 10 is removed. This aperture 4 is open 180 degrees around the circumference of the upper pen casing 5. Part 5 illustrates where the lip balm cartridge 9 will be stored. The vertical, slotted opening 6 in the upper casing 5 will open between 90 degrees and 135 degrees to accommodate loading and unloading of the lip balm cartridge 9.

Figure 2:
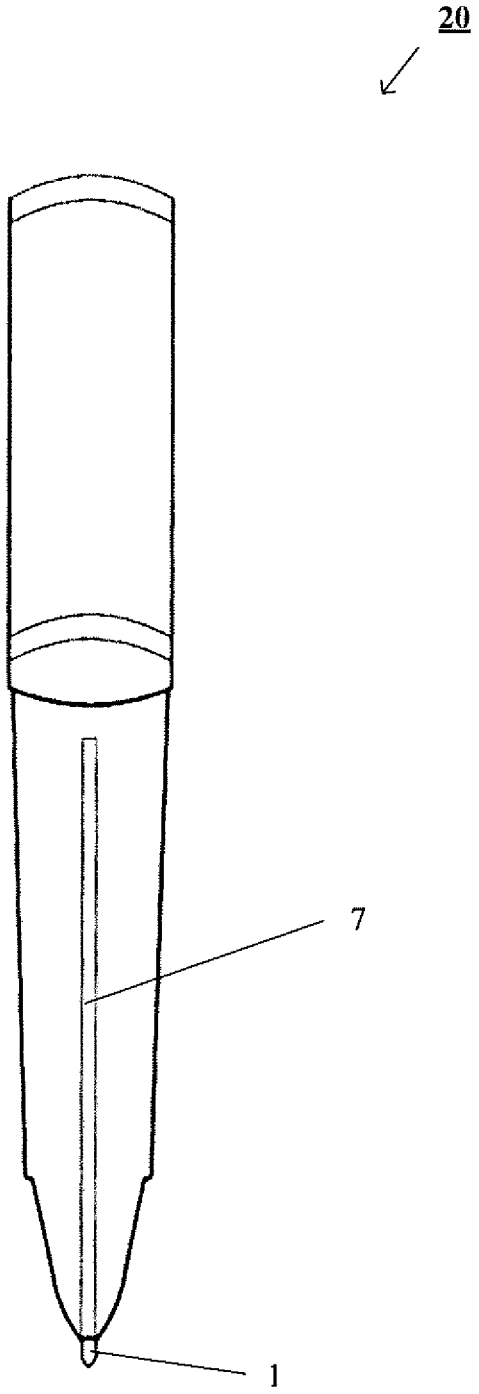
FIG. 2 is a cross-section of the inside of the lower housing unit of the pen shown in FIG. 1.

FIG. 2 demonstrates a cross-section of the pen 20. Part 1 shows the retractable pen tip 1 and part 7 shows the ink tube carrying the ink.

The color of the pen FIG. 1 parts 2,3, and 5 can be any solid, pattern, or design color.

The ink used to write can be any color.

The length of the entire unit will be from 5 to 6 inches.

The pen may be altered to include rubber grips or illuminate part 2 in FIG. 1.

Figure 3:
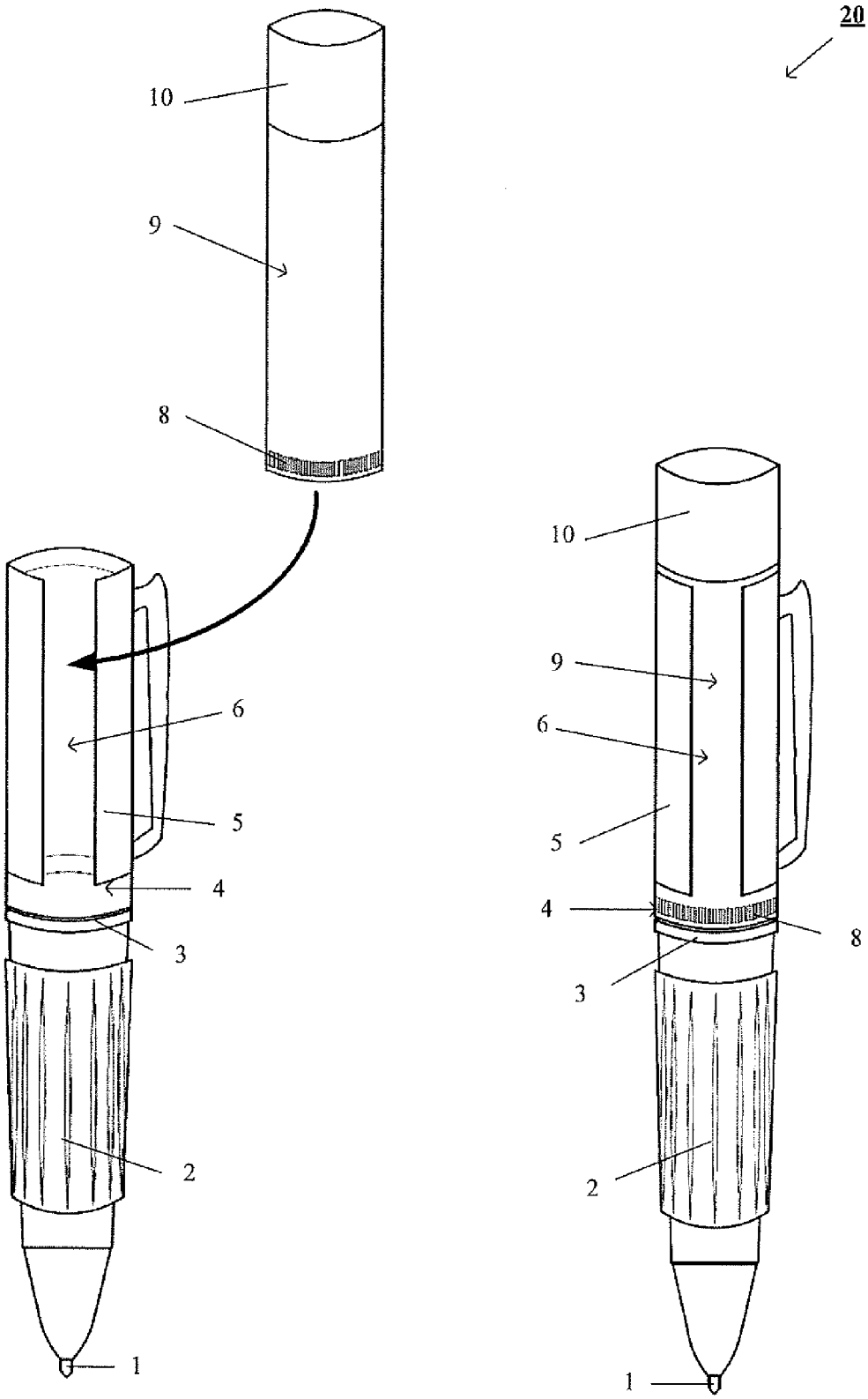
FIG. 3 is an illustration of how the lip balm cartridge is received into the upper section of the pen device.

A metal or plastic clip may be added to the upper housing unit FIG. 1, part 5, as illustrated in FIG. 3.

The invention claimed is:

1. A pen, comprising:

a lower housing section constructed to hold a retractable pen tip and ink tube;

an upper housing section constructed and sized to hold a lip balm cartridge; and an expandable opening in the side of the upper housing for inserting the lip balm cartridge into the upper housing.

2. The pen according to claim 1 further comprising a rotatable union between the lower housing section and the upper housing section for retracting the pen tip.

3. The pen according to claim 1 further comprising a horizontal aperture at the base of the upper housing section that is positioned to allow a user to release a selected amount of lip balm from the lip balm cartridge.

4. The pen according to claim 2 wherein the horizontal aperture provides an opening of about 180 degrees.

5. The pen according to claim 1 wherein the expandable opening in the upper housing further comprises a vertical slot in the upper housing constructed to facilitate loading and unloading of the lip balm cartridge.

6. The pen according to claim 5 wherein the vertical slot can be extended in the range of about 45 degrees to about 135 degrees.

7. The pen according to claim 1 wherein the expandable opening in the upper housing further comprising a vertical slot in the upper housing constructed to facilitate snapping the lip balm cartridge into the upper housing.

* * * * *